US007828530B2

(12) United States Patent
Queirel

(10) Patent No.: US 7,828,530 B2
(45) Date of Patent: Nov. 9, 2010

(54) ELECTRIC MOTOR PUMP FOR SWIMMING POOL MAINTENANCE

(75) Inventor: Joël Queirel, Troyes (FR)

(73) Assignee: Financiere Piscine Equipement, Paris (FR)

( * ) Notice: Subject to any disclaimer, the term of this patent is extended or adjusted under 35 U.S.C. 154(b) by 597 days.

(21) Appl. No.: 10/532,653

(22) PCT Filed: Oct. 24, 2003

(86) PCT No.: PCT/FR03/03171

§ 371 (c)(1),
(2), (4) Date: Oct. 31, 2005

(87) PCT Pub. No.: WO2004/040144

PCT Pub. Date: May 13, 2004

(65) Prior Publication Data

US 2006/0104840 A1 May 18, 2006

(30) Foreign Application Priority Data

Oct. 25, 2002 (FR) ..... 02 13384

(51) Int. Cl.
*F04B 3/00* (2006.01)
*F04B 5/00* (2006.01)
*F04B 25/00* (2006.01)

(52) U.S. Cl. ..... 417/251; 417/247; 417/368; 417/369

(58) Field of Classification Search ..... 417/247, 417/251, 423.14, 338, 347, 348, 357, 366, 417/368, 369, 370, 371
See application file for complete search history.

(56) References Cited

U.S. PATENT DOCUMENTS

| | | | | | |
|---|---|---|---|---|---|
| 2,887,062 | A * | 5/1959 | Cametti et al. | ..... | 417/357 |
| 3,822,754 | A * | 7/1974 | Henkin et al. | ..... | 180/7.1 |
| 4,616,980 | A * | 10/1986 | Carpenter | ..... | 417/357 |
| 4,678,409 | A * | 7/1987 | Kurokawa | ..... | 417/420 |
| 4,969,803 | A * | 11/1990 | Turanskyj | ..... | 417/247 |
| 5,049,770 | A * | 9/1991 | Gaeth et al. | ..... | 310/89 |
| 5,392,473 | A * | 2/1995 | Idland et al. | ..... | 4/541.1 |
| 5,888,053 | A * | 3/1999 | Kobayashi et al. | ..... | 417/244 |
| 6,167,724 | B1 * | 1/2001 | Pozivil | ..... | 417/251 |
| 6,217,754 | B1 | 4/2001 | Ros | | |

FOREIGN PATENT DOCUMENTS

| | | |
|---|---|---|
| EP | 0 544 610 | 6/1993 |
| EP | 0 846 817 | 6/1998 |
| EP | 0 969 167 | 1/2000 |
| FR | 2 705 384 | 11/1994 |
| FR | 2 790 501 | 9/2000 |

* cited by examiner

*Primary Examiner*—Devon C Kramer
*Assistant Examiner*—Peter J Bertheaud
(74) *Attorney, Agent, or Firm*—Young & Thompson

(57) ABSTRACT

The invention concerns a dual pump, comprising an electric motor (18) including a drive shaft, the shaft including, at each of its axial ends, a shaft output (21, 22), and two pump impellers, each shaft output driving a respective pump impeller, one first of the pump impellers (23) operating at low pressure and high flow rate, and the second of the pump impellers (30) operating at higher pressure and lower flow rate. The water pumped by the second pump impeller (30) is drawn proximate the outlet of the first pump impeller (23) and returns to the inlet of the second pump impeller. The drawing point is situated in a low pressure pump chamber, upstream of the low pressure outlet (16). The invention is applicable to swimming pool maintenance.

15 Claims, 3 Drawing Sheets

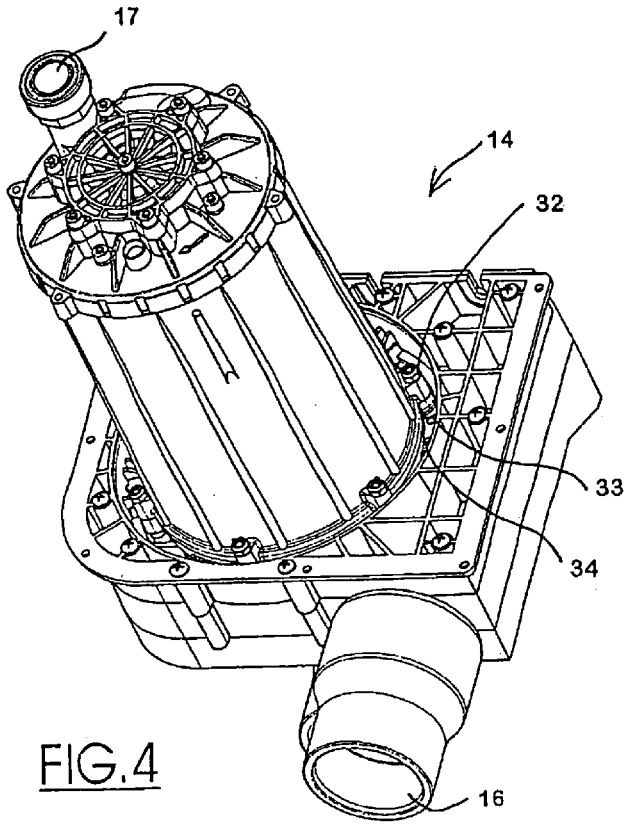
FIG.4
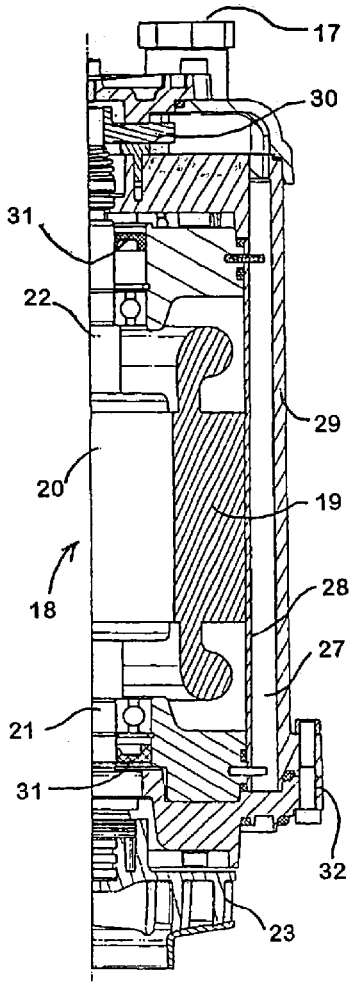
FIG.6
FIG.5
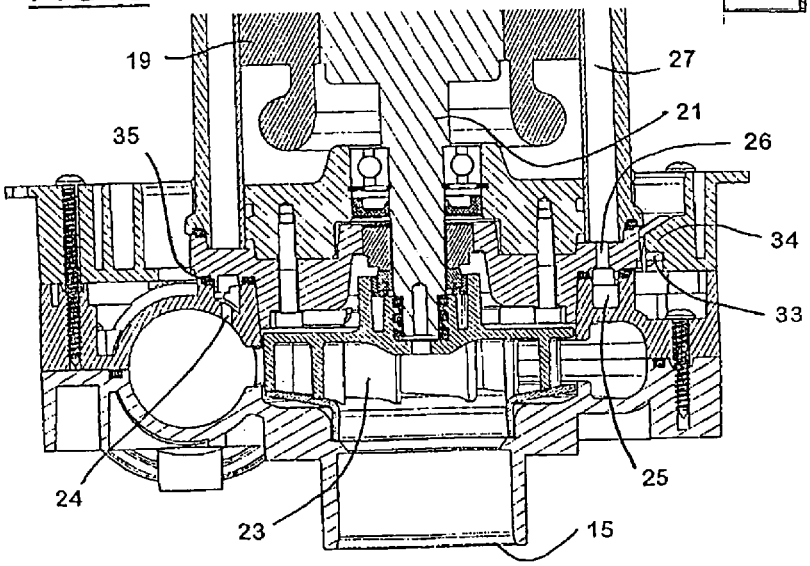

ELECTRIC MOTOR PUMP FOR SWIMMING POOL MAINTENANCE

The present invention relates to a dual electric pump intended for the maintenance of swimming pools.

It is known that the maintenance of swimming pools requires the circulation of a plurality of currents of water. The water from the pool thus circulates in a filtration assembly, water is conveyed to a device for cleaning the swimming pool, water is used to draw away the debris, leaves and the like deposited on the surface of the swimming pool, water is removed by means of a plug at the bottom of the swimming pool, etcetera. These different circulations of water are brought about by respective pumps which are each adapted to the required flow rate and pressure.

The large number of pumps, and therefore motors which drive them, renders the equipment of swimming pools complex and the object of the invention is to reduce this complexity.

More precisely, the subject-matter of the invention is a dual pump which has a single electric motor and which is intended to perform the function of two different pumps which are conventionally used for the maintenance of swimming pools.

Although the use of a dual pump of this type may be applied to various currents of the swimming pool, the invention is described in terms of its application to the circulation of the filtration current and the circulation of the supply current for a cleaning device.

More precisely, the invention relates to a dual pump having an electric motor having a shaft, each end of which drives a respective pump.

According to the invention, an electrically driven pump for the maintenance of swimming pools comprises an electric motor having a drive shaft, the shaft having, at each of the axial ends thereof, a shaft output and two pump impellers, each shaft output driving a respective pump impeller, the first of the impellers operating at a low pressure and high flow rate, and the second of the impellers operating at a higher pressure and lower flow rate.

The maintenance assembly for swimming pools is thus simplified since a single electric motor, and therefore a single electrical connection, is required and the programming of the filtration and operation times for the cleaning device is simplified.

It is advantageous for the water pumped by the second pump impeller to be drawn off close to the outlet of the first pump impeller and to return to the inlet of the second impeller. Preferably, the draw-off location is located in a low-pressure pump body, upstream of the low-pressure outlet.

The pump is thus a pump which has two outlet steps operating in parallel and partially in series and which is capable of providing the flow rates and pressures required, for example, for the filtration and the operation of a cleaning device, with excellent efficiency.

According to a very advantageous feature, the water pumped by the second pump impeller between the draw-off location and the inlet towards the second pump impeller circulates around the motor in order to cool the motor.

In this manner, the electric motor of the pump is cooled under all operating conditions and no special ventilation of the region is required, with the result that the energy loss is minimised.

In a first variant, the circulation of the water pumped by the second pump impeller is carried out in a coiled pipeline which surrounds the motor.

In a second variant, the circulation of the water pumped by the second pump impeller is carried out in a cylindrical space formed around the motor, between the motor and an external housing.

It is advantageous for the assembly formed by the motor, the housing, the two pump impellers and the high-pressure pump body to be connected in a releasable manner to the body of the low-pressure pump. In one embodiment, the releasable connection between said assembly and the low-pressure pump body is carried out by means of bayonet-type locking. It is therefore advantageous for the low-pressure pump body to be incorporated in a concrete block which also contains a water filtration device for swimming pools.

In one example of use, the impeller which operates at a low pressure and high flow rate is intended for the filtration of the pool water, and the other impeller which operates at a higher pressure and lower flow rate is intended for a cleaning device for swimming pools.

Other features and advantages of the invention will be better appreciated from the following description of embodiments, given with reference to the appended drawings, in which:

FIG. 4 is a perspective view of another embodiment of the dual pump according to the invention;

FIG. 5 is a section of the lower portion of the pump illustrated in FIG. 4; and FIG. 6 is a half-section of the pump of FIG. 4, taken along a different plane from the section plane of FIG. 5.

Figure 1:
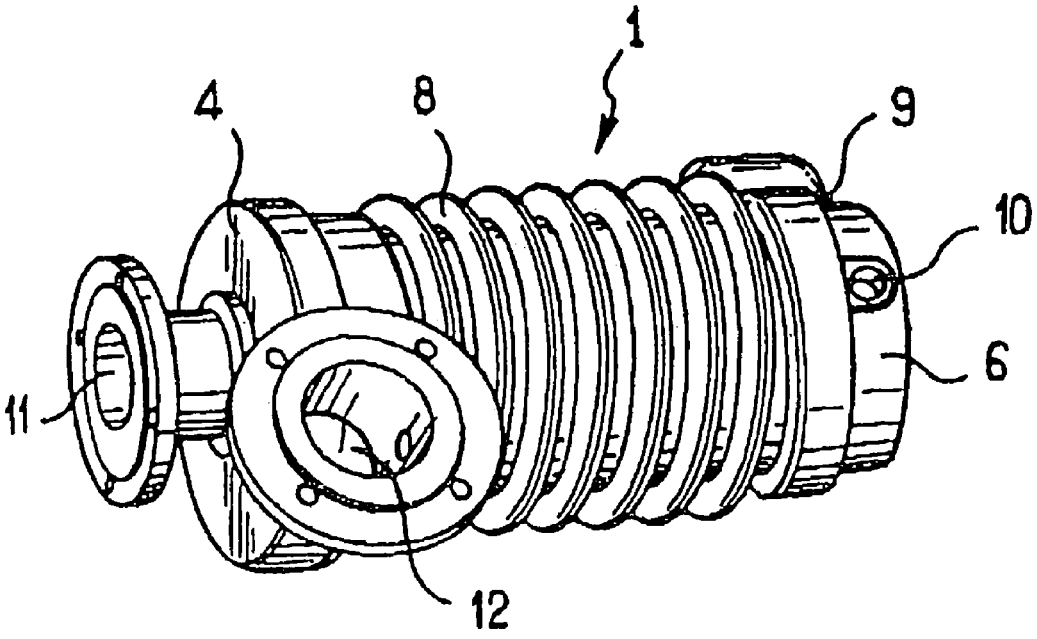
FIG. 1 is a perspective view of a pump when viewed from the side of the water outlets.
Figure 2:
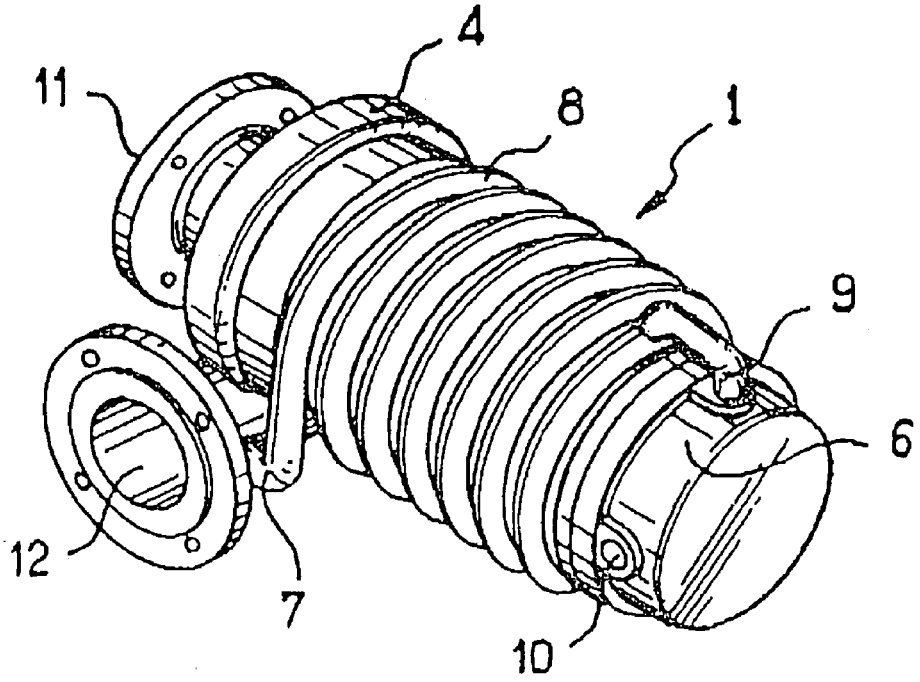
FIG. 2 is another perspective view of the pump when viewed from the side of the high-pressure pump impeller.
Figure 3:
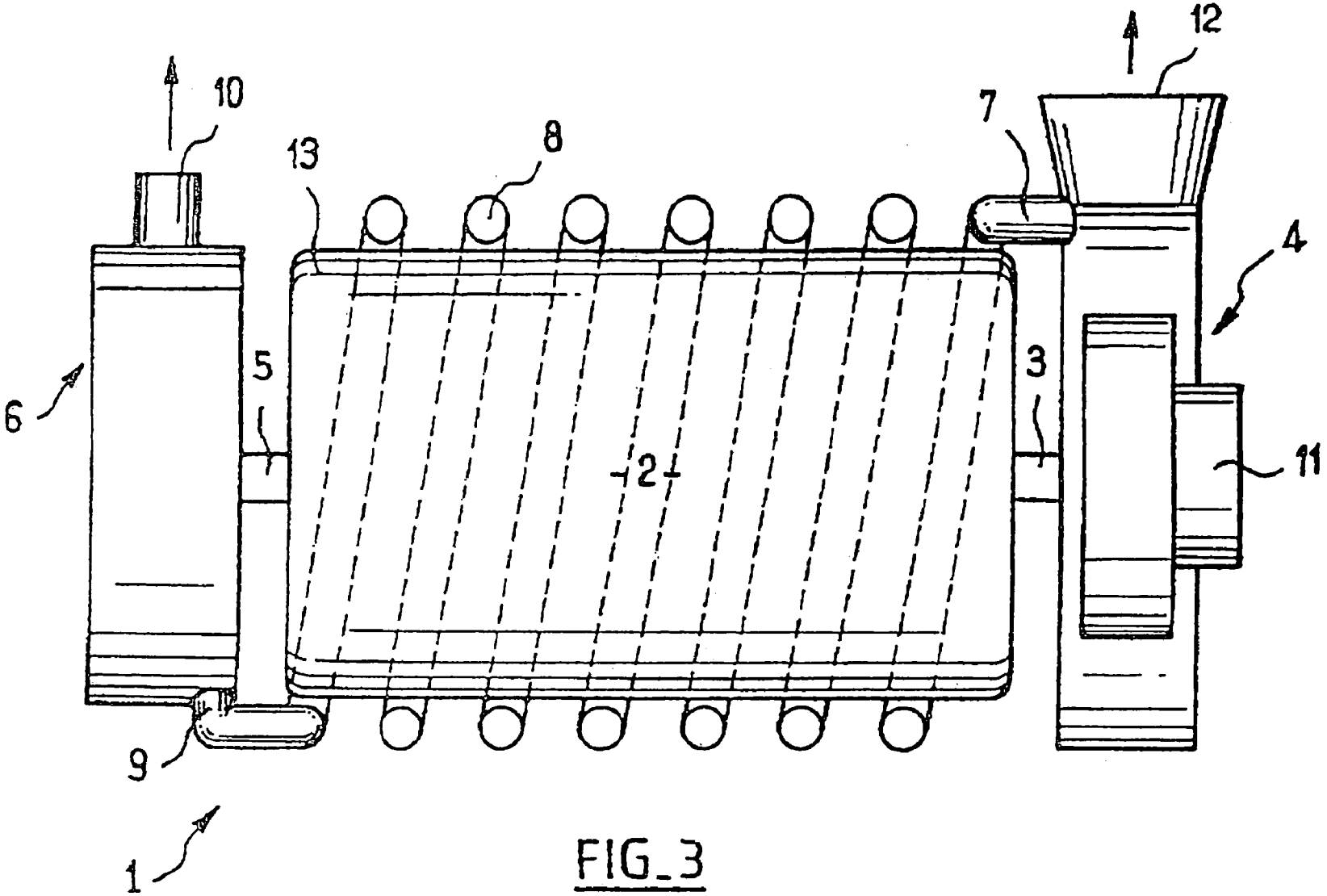
FIG. 3 is a partially sectioned side view of the pump of FIGS. 1 and 2.

In FIGS. 1 to 3, a pump 1 comprises an electric motor 2 having a shaft, one end of which forms a shaft output 3 which is intended to drive a pump impeller. At this first end, a first impeller 4 provides low-pressure pumping at a high flow rate for the filtration circuit of the swimming pool whilst, at the other opposite end of the motor, the other shaft output 5 drives a second impeller 6 for pumping at medium or high pressure at a low flow rate which is intended for controlling a cleaning device for swimming pools. The water of the swimming pool enters via an axial aperture 11 and leaves the low-pressure pump 4 via an outlet 12, towards the pool of the swimming pool.

According to one feature which is advantageous but not indispensable, the water intended for the pump impeller 6 is drawn off close to the outlet of the low-pressure pump impeller 4. In FIG. 2 in particular, the reference numeral 7 designates a connection for a pipe 8 which supplies, via an inlet 9, the medium- or high-pressure pump whose outlet is designated 10.

In the embodiment illustrated, the pipe 8 surrounds the housing 13 of the motor, with a coil-like arrangement being formed which is arranged in close contact with this housing, for example, by means of welding. The water which circulates in the pipe 8 provides effective cooling for the electric motor which is located in the housing 13. This feature is very advantageous since the electric motor is cooled in an optimum manner without it being necessary to ventilate the region in which the pump is located, in an effective manner and without consuming energy.

In one embodiment, an electric motor rated at 1700 W which is supplied with alternating current at 220V drives a first pump impeller 4 which provides a flow rate of 18 $m^3/h$ at a pressure of 1.3 bar, and a second pump impeller 6 which provides a flow rate of 2 $m^3/h$ at a pressure of 2.8 bar for the operation of the device. The second pump impeller 6 therefore increases the pressure of the water which is intended for the operation of the device from 1.3 to 2.8 bar.

The examples given for the power of the motor and for the flow rates and pressures of the pump impellers used for the filtration and for the operation of the device are only examples which must be modified in accordance with the technical features of the swimming pool and in particular the dimensions of the pool thereof. When the device is not used, the water from the second pump impeller can be conveyed directly to the pool of the swimming pool or used for another purpose.

FIGS. 4 to 6 illustrate another embodiment of the dual pump according to the invention. This pump 14 draws in water via an inlet 15 and conveys the water in the form of a low-pressure current having a high flow rate. An outlet 17 conveys a high- or medium-pressure current having a low flow rate.

The pump is driven by means of an electric motor 18 which comprises a stator 19 and a rotor 20. The stator comprises windings which are supplied with electrical current in conventional manner and which are not illustrated. The rotor 20 is fixedly joined to a shaft having two outputs or ends 21 and 22.

The first low-pressure pump impeller 23 having a high flow rate is mounted on a first shaft output 21. As illustrated in FIG. 5, this impeller rotates in a centrifugal pump body which opens via the outlet 16. Upstream of this outlet 16, an opening 24 connects an adjacent location of the outlet of this pump to an annular space 25 which communicates, via openings 26, with a space 27 which is formed between an inner duct 28 which forms a support for the motor 18 which is located at the inner side and a housing 29 which is concentric relative to the duct 28. The space 27 is therefore a cylindrical space formed completely around the motor.

This space, which is supplied by the openings 26 located at the lower portion of the pump as illustrated in FIG. 6, joins, at the upper portion of this Figure, a second pump impeller 30 which is intended to increase the pressure of the water which is conveyed in this manner. The water at high or medium pressure having a low flow rate is thus discharged via the outlet 17. This pump impeller 30 is mounted on the other end 22 of the shaft of the electric motor 18.

It can further been seen in FIG. 6 that the motor 18 is separated from the two pump impellers in a fluid-tight manner by means of lip-type seals 31. The electric motor 18 is thus surrounded in a fluid-tight manner at the inner side of the space of the duct 28. The stator 19 is force-fitted in the duct 28, with the result that the exchange of heat between the stator 19 and the water which circulates in the cylindrical space 27 via the metal duct 28 is excellent.

FIGS. 4, 5 and 6 illustrate another advantageous feature of the pump according to the invention which is used for the maintenance of swimming pools. According to this feature, the assembly illustrated in FIG. 6, that is to say, the motor, the housing, the two pump impellers and the body of the high-pressure pump as a whole, forms an assembly which can be separate from the body of the low-pressure pump. As indicated in FIG. 5, the assembly illustrated in FIG. 6 and the body of the low-pressure pump co-operate by means of two fluid-tight seals 35 which are arranged substantially in the same plane and which are concentric relative to each other.

The strength of the assembly illustrated in FIG. 6, which is fixedly joined by means of bolts 32, is provided by means of tongues 33 which are fixedly joined to the releasable assembly illustrated in FIG. 6 and which are inserted below fingers 34 which extend beyond the body of the low-pressure pump. These assemblies comprising tongues and fingers are distributed in a uniform manner around the pump so that the assembly illustrated in FIG. 6 can be fixed to the body of the low-pressure pump by means of rotation about the axis thereof, the tongues 33 and the fingers 34 forming a bayonet-type locking assembly.

In this case, the body of the low-pressure pump can be connected in a robust manner to the filtration assembly for the swimming pool and to other elements, the whole being cast in concrete. The parts which may require maintenance, that is to say, the assembly illustrated in FIG. 6, can be readily separated from the low-pressure pump body which is then integrated in the concrete block which contains the filtration system for the swimming pool.

In this manner, since a dual pump replaces two pumps which are conventionally used, the invention allows the cost of installation to be considerably reduced. Since the motor is cooled in an excellent manner, it can, on the one hand, function with a high level of efficiency under all conditions of use, and, on the other hand, the temperature of the rotating parts, bearings, joints and other wear parts remains low, with the result that the service life of the pump is extended considerably. Since a single dual pump is used instead of two pumps, the space required for the assembly is reduced. Furthermore, since there is only one motor provided, the operating noises are reduced, especially since no ventilation is required for cooling the motor. Furthermore, since the motor drives a pump at each end, it can be readily balanced.

Although the invention has been described with reference to a pump which is used to circulate water in the filtration circuit and for the operation of the cleaning device, other applications are possible. For example, when the operation of the cleaning device is not required, it is possible to use the high- or medium-pressure flow rate for any other type of device for cleaning pools, for massage, for increasing the flow rate, for example, for the filtration circuit, etcetera.

Of course, various modifications can be carried out by the person skilled in the art to the pumps, which have been described above only by way of non-limiting example, without departing from the scope of the invention.

The invention claimed is:

1. Electrically driven pump for the maintenance of swimming pools in combination with a swimming pool filter and a swimming pool cleaning device, comprising:

an electric motor having a drive shaft with axial ends, a first shaft output at a first of the axial ends, a second shaft output at a second of the axial ends, a first pump impeller at the first axial end and driven by the first shaft output, the first impeller operating at a low pressure and high flow rate, the first impeller having a first outlet and a second outlet to an exterior of the pump, a second pump impeller at the second axial end and driven by the second shaft output, the second impeller operating at a higher pressure and lower flow rate as compared to the first impeller, the second impeller having an inlet and a first outlet to the exterior of the pump, wherein the first outlet of the first impeller is connected to the inlet of the second impeller and delivers low pressure water to the inlet of the of the second impeller so that the water flows from a region of low pressure toward a region of higher pressure, wherein the second outlet of the first impeller and the first outlet of the second impeller are separate outlets to the exterior of the pump, wherein the second outlet of the first impeller is connected to an inlet of the filter, and wherein the first outlet of the second impeller is connected to an inlet of the cleaning device.

2. The combination according to claim 1, wherein, after the water is pumped by the first pump impeller and before the water is pumped by the second pump impeller, the water circulates around the motor in order to cool the motor.

3. The combination according to claim 1, wherein the first outlet of the first impeller is close to the second outlet of the first impeller.

4. The combination according to claim 3, wherein the first outlet of the first impeller is located upstream of the second outlet.

5. The combination according to claim 4, wherein, the circulation of the water, after the water is pumped by the first pump impeller and before the water is pumped by the second pump impeller, is carried out in a coiled pipeline which surrounds the motor.

6. The combination according to claim 4, wherein, the circulation of the water after the water is pumped by the first pump impeller and before the water is pumped by the second pump impeller, is carried out in a cylindrical space formed around the motor, between the motor and an external housing.

7. The combination according to claim 6, wherein, the external housing includes a high-pressure pump body comprising the second pump impeller, and a low-pressure pump body comprising the first pump impeller; and wherein the high-pressure pump body is coupled via a releasable connection to the low-pressure pump body.

8. The combination according to claim 7, wherein, said releasable connection is carried out by means of bayonet-type locking.

9. The combination according to claim 2, wherein the first outlet of the first impeller is close to the second outlet of the first impeller.

10. The combination according to claim 1, wherein, the first pump impeller provides a flow rate of 18 $m^3$/hr at a pressure of 1.3 bar, and the second pump impeller provides a flow rate of 2 $m^3$/hr at a pressure of 2.8 bar.

11. System for maintenance of swimming pools, comprising:

means for filtering the swimming pool;

a cleaning device for the swimming pool; and an electrically driven pump comprising i) an electric motor having a drive shaft with axial ends, a first shaft output at a first of the axial ends, and a second shaft output at a second of the axial ends, ii) a first pump impeller at the first axial end and driven by the first shaft output, the first impeller operating for pumping water at a low pressure and high flow rate having a first outlet and a second outlet to the exterior of the pump, iii) a second pump impeller operating at the second axial end and driven by the second shaft output, the second impeller operating for pumping water at a higher pressure and a lower flow rate as compared to the first impeller, the second impeller having an inlet and a first outlet to the exterior of the pump, wherein the first outlet of the first impeller is connected to the inlet of the second impeller and delivers low pressure water to the inlet of the second impeller so that the water flows from a region of low pressure toward the region of higher pressure, and wherein the second outlet of the first impeller and the first outlet of the second impeller are separate outlets exterior to the pump, wherein the second outlet of the first impeller is used in combination with the means for filtering the swimming pool, and wherein the first outlet of the second impeller is connected to the cleaning device.

12. The system according to claim 11, wherein, the first pump impeller provides a flow rate of 18 m3/hr at a pressure of 1.3 bar, and the second pump impeller provides a flow rate of 2 $m^3$/hr at a pressure of 2.8 bar.

13. Electrically driven pump for the maintenance of swimming pools in combination with a swimming pool filter and a swimming pool cleaning device, comprising:

an electric motor comprising a stator and a rotor, the rotor fixedly joined to a shaft having axial ends defining a first shaft output at a first of the axial ends and a second shaft output at a second of the axial ends;

a centrifugal pump body with a exterior outlet and an internal outlet located upstream of the exterior outlet, the pump body having an exterior first face and an opposite exterior second face;

a first pump impeller at the first axial end and driven by the first shaft output, the first impeller operating at a low pressure and high flow rate, the first pump impeller rotating in the centrifugal pump body and discharging to the exterior outlet and the internal outlet;

an annular space connected to the internal outlet;

discharge openings in the annular space;

a housing extending outward from the first face of the pump body;

an inner duct within the housing, the inner duct supporting the motor;

a cylindrical space located between the inner duct and an inner side of the housing, the cylindrical space in fluid communication, via the discharge openings, with the annular space, the cylindrical space formed completely around the motor; and a second pump impeller at the second axial end and driven by the second shaft output, the second impeller operating at a higher pressure and lower flow rate as compared to the first impeller, the second impeller having an inlet in fluid communication with the cylindrical space and an outlet to the exterior of the pump, wherein the first outlet of the first impeller is connected to the inlet of the second impeller and delivers low pressure water to the inlet of the of the second impeller so that the water flows from a region of low pressure toward a region of higher pressure, and wherein the second outlet of the first impeller and the first outlet of the second impeller are separate outlets to the exterior of the pump, wherein the second outlet of the first impeller is connected to an inlet of the filter, and wherein the first outlet of the second impeller is connected to an inlet of the cleaning device.

14. The combination according to claim 13, wherein, the first pump impeller provides a water flow rate of 18 m3/hr at a pressure of 1.3 bar, and the second pump impeller provides a water flow rate of 2 $m^3$/hr at a pressure of 2.8 bar.

15. The combination of claim 13, wherein the housing is detachable from the pump body.

* * * * *